United States Patent [19]

Flederbach et al.

[11] Patent Number: 4,462,653

[45] Date of Patent: Jul. 31, 1984

[54] ELECTRICAL CONNECTOR ASSEMBLY

[75] Inventors: Mark Flederbach, Sidney; David O. Gallusser, Oneonta, both of N.Y.

[73] Assignee: The Bendix Corporation, Southfield, Mich.

[21] Appl. No.: 325,519

[22] Filed: Nov. 27, 1981

[51] Int. Cl.[3] ..... H01R 13/62

[52] U.S. Cl. ..... 339/89 R; 285/82; 339/90 R; 339/DIG. 2

[58] Field of Search ..... 339/90 R, 90 C, 89 R, 339/89 C, 89 M, DIG. 2; 285/81, 82

[56] References Cited

U.S. PATENT DOCUMENTS

| | | | |
|---|---|---|---|
| 2,728,895 | 12/1955 | Quackenbush et al. | 339/89 R |
| 3,552,777 | 1/1971 | Heinrich et al. | 285/81 |
| 3,594,700 | 7/1971 | Nava et al. | 339/89 R |
| 3,786,396 | 1/1974 | Kemmer et al. | 339/DIG. 2 |
| 3,808,580 | 4/1974 | Johnson | 339/89 R |
| 4,056,298 | 11/1977 | Cooper et al. | 339/89 M |
| 4,152,039 | 5/1979 | Shah | 339/89 M |
| 4,268,103 | 5/1981 | Schildkraut et al. | 339/89 M |
| 4,359,254 | 11/1982 | Gallusser et al. | 339/89 M |
| 4,407,529 | 10/1983 | Holman | 339/89 R |

OTHER PUBLICATIONS

John S. Scott, Dictionary of Civil Engineering Third Edition, 1981, p. 77, Granada Publishing Limited.

*Primary Examiner*—John McQuade
*Assistant Examiner*—Paula Austin
*Attorney, Agent, or Firm*—C. D. Lacina

[57] ABSTRACT

An electrical connector assembly (100) includes a coupling ring (50) for connecting together two connector housings (10, 20) and self-contained means for resisting rotation of the coupling ring relative to the connector housing (20) to which it is rotatably mounted. The resisting means includes coupling ring (50) and connector housing (20) respectively, frusto-conical surfaces (72, 82) with protuberances (74) and sockets (84), in faced relation, the protuberances being adapted to be received in and rotated to succeeding sockets. The compressible plastic is such that as the housings are drawn into tight engagement the protuberances on the coupling ring engage the plastic surface on the other connector housing (10), causing the protuberances and surfaces to elastically compress. The tapered shoulders enhance engagement therebetween to increase the frictional forces resisting the vibration and radially locates the coupling ring with respect to the connector components to minimize hammering in shock prone environments resulting from radial clearances therebetween.

19 Claims, 11 Drawing Figures

COUPLING
UNCOUPLING

ELECTRICAL CONNECTOR ASSEMBLY

This invention relates to an electrical connector assembly including a coupling ring for maintaining connection between a pair of electrical connector housings and more particularly to means for resisting unwanted disconnection between the coupling ring and connector housings.

One electrical connector housing is generally interfittable with the other electrical connector housing and each connector housing generally carries one or more electrical contacts, the contacts of one connector housing being matable with the contacts of the other connector housing when the connector housings are connected together. The coupling ring is generally mounted for rotation to one of the connector housings by means of one or more snap rings captivating a radial flange of the coupling ring against a radial shoulder of the connector housing. A threaded portion of the coupling ring is arranged to be threaded onto the other connector housing, both of the connector housings being drawn together and connected when the coupling ring is rotated in a coupling direction and decoupled when rotated in a decoupling direction.

Because engagement of the other housing with the coupling ring is by sliding rotational movement and because the coupling ring is held in place solely by friction, the coupling ring may tend to loosen under the influences of vibration (e.g., hammering) to which the connected housings may be subjected. Where such a vibrational loosening occurs, one prior practice has been to secure the coupling ring against inadvertent loosening by threading safety wire through a hole in the coupling ring and a hole in a fixed member located near the connection and twisting the safety wire ends together. This practice is not altogether satisfactory in that pliers and other tools are usually required to fasten the safety wire, the safety wire-to-coupling ring cannot readily be removed without the use of the same tools and often the coupling ring must be installed in places in which manipulation of the tools and wire is difficult at best. A user would like to have a connector which is self-contained and characterized by ease of uncoupling when desired.

To provide the coupling ring with self-contained means for resisting rotation that permit ready connection and/or disconnection are known. U.S. Pat. No. 2,728,895, issuing Dec. 27, 1955 and entitled "Self-Locking Coupling Device" showed a somewhat complex mechanism that required several interlocking parts, which locked a ring from rotation but which could be unlocked by hand manipulation to permit disconnection of parts when desired. In many environments, complex parts may not function and a user may find the apparatus difficult to unlock. U.S. Pat. No. 4,268,103 issuing May 1, 1979 and entitled "Electrical Connector Assembly Having Anti-Decoupling Mechanism" showing a coupling ring with a chordal spring beam of metal having a plastic tooth arranged to engage a plurality of metal teeth on the connector. The spring beam shown, although excellent in reducing metal-to-metal wear, could be adversely effected under vibration. A similar arrangement is shown in U.S. Pat. No. 3,594,700 issuing July 20, 1971 and entitled "Electrical Connector with Threaded Coupling Nut Lock".

For one reason or another, in the past connectors have typically been formed of metal. For example metal meets certain MIL-specifications and provides for electromagnetic interference protection when connector housing faces are in metal-to-metal contact. Of course, metals are incompressible, heavy, prone to wear and usually require lubrication of moving parts. However, although a finished product of plastic is substantially less expensive than metal, weighs less than metal and offers a performance approaching that of the metal connectors, molding technology has not always kept pace with the desires of the marketplace. A plastic electrical connector assembly in U.S. Pat. No. 4,152,039, issuing May 1, 1979, and entitled "Non-Decoupling Electrical Connector" shows a coupling nut having a self-contained annular spring beam molded into the connector. As noted above, springs can be effected by vibration. Also, depending on the temperature, plastic becomes brittle and possibly break because of compressive forces during rotation, particularly in an uncoupling direction. A durable plastic member would be desirable.

Accordingly, a desirably connector would be self-contained, provide a pair of electrical connector housings with a coupling ring which will permit ready connection and/or disconnection, resist unwanted decoupling of the electrical connector assembly formed, eliminate use of metal connector parts and allow fabrication of the connector by less costly plastic which will provide non-decoupling during vibration and yet which will not become easily damaged when the connector is uncoupled.

DISCLOSURE OF THE INVENTION

According to the invention, a one-piece coupling ring is captivated for rotation adjacent a radial flange of a first electrical connector housing such that an internal frusto-conical surface of the coupling ring is disposed in faced relation to an external frusto-conical surface of the radial flange. The internal frustoconical surface of the coupling ring is provided with a plurality of equiangularly spaced sockets sized to receive a lesser number of equiangularly spaced protuberances extending outwardly from the external frusto-conical surface of the radial flange. Each of the protuberances, as well as the frusto-conical surfaces, are of a tough but compressible plastic material which, due to the compressibility of the plastic, elastically deforms as the coupling ring is rotated. Compression of the protuberances and that part of the surface contacted thereby allows the coupling ring to advance between first and second positions, each protuberance snapping into its next succeeding socket.

One advantage of the invention is that it reduces the number of parts necessary to mount a coupling member to an electrical connector housing.

Another advantage of the invention is the provision of a anti-decoupling means that does not undergo successive wear under coupling and uncoupling motions.

Another advantage of the invention is having the anti-decoupling means self-contained on the connector member.

Detailed Description of the Invention

Figures 1, 2, 3:
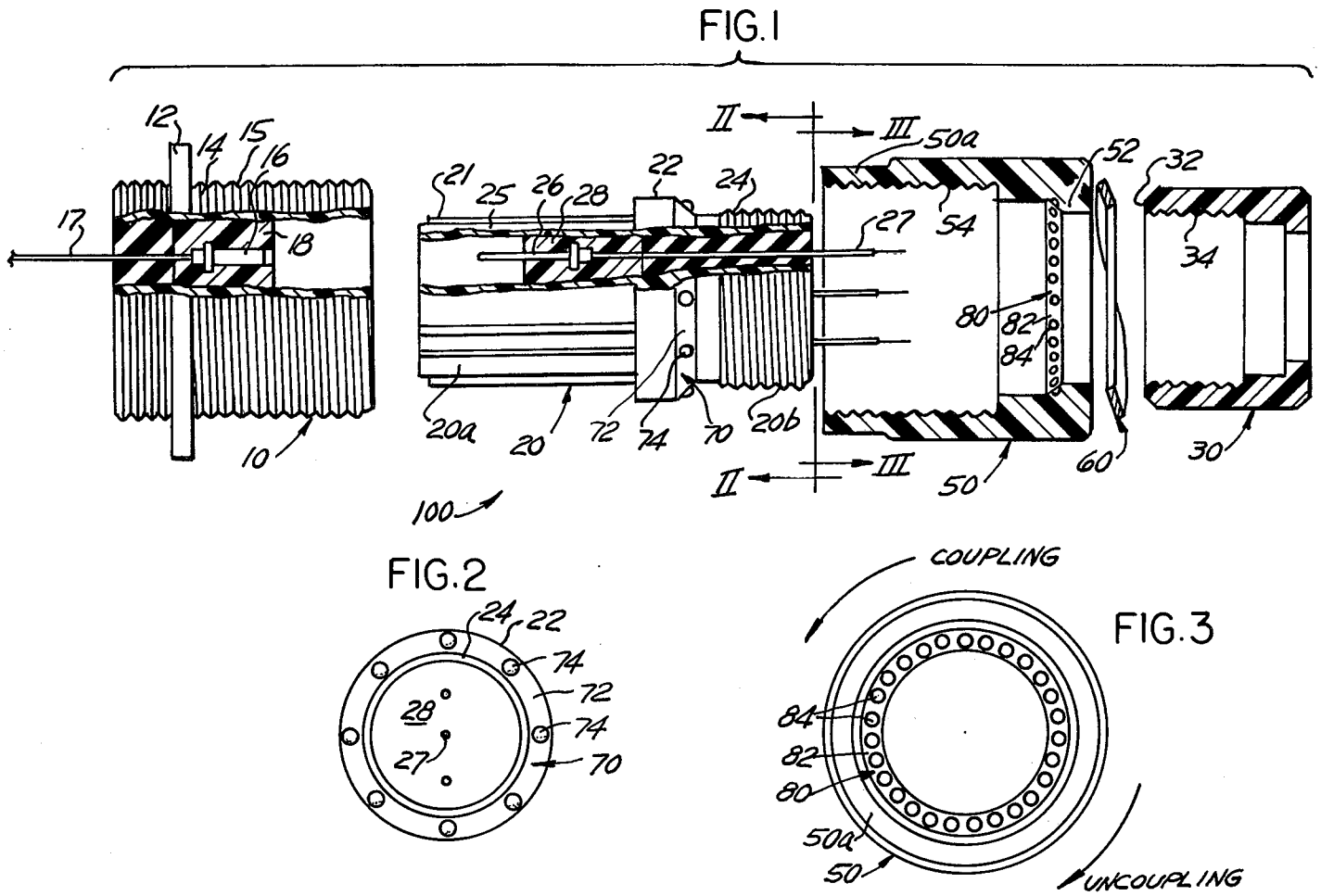
FIG. 1 is a view, partially in section, of a disconnected electrical connector assembly including a coupling ring and electrical connector housing constructed in accordance with the invention.
FIG. 2 is taken along lines II—II of FIG. 1 and is a rear end view of the electrical connector housing.
FIG. 3 is taken along lines III—III of FIG. 1 and is a front end view of the coupling ring.

Referring now to the drawings, FIG. 1 illustrates an electrical connector assembly 100 comprising a first electrical connector housing (a receptacle shell) 10 and a second electrical connector housing (i.e., a plug shell) 20. Each are multi-contact connectors and each are adapted to be drawn together along their primary axes.

The first connector housing (i.e. the receptacle shell) 10 includes a plurality of socket contacts 16 affixed in a dielectric insert 18 which is retained in the receptacle shell in a conventional manner. Wires 17 are shown terminated by the contact 16 and extending from the connector. Suitably, receptacle shell 10 includes a cylindrical forward portion 15 having its exterior provided with a threaded portion 14 and its interior provided with a keyway (not shown). Typically, a radial flange 12 is disposed medially about the shell.

The second connector housing (i.e. the plug shell) 20 includes a plurality of pin contacts 26 affixed in a resilient dielectric insert 28 which is retained the plug shell in a conventional matter. Wires 27 are shown terminated by the pin contact 26 and extending from the plug shell. Suitably, plug shell 20 includes a cylindrical forward portion 25 that extends substantially beyond a forward end face of insert 28 to cover the pin contacts where they extend from insert and which is provided with a longitudinal key 21 sized to fit within the receptacle shell keyway, the key and keyway serving to orient and to prevent rotational movement of the connector housings when assembled. Plug shell 20 has an engaging forward end **20*a*, a generally cylindrical non-engaging rearward end 20*b* having external threads 24 and an external radial flange 22** located medial the ends of shell.

A generally cylindrical coupling ring 50 having an inwardly extending radial flange 52 is adapted to be seated at non-engaging end **20*b* of and adjacent radial flange 22 of plug shell 20, the seating permitting a forward end 50*a* of coupling ring 50 to rotate freely about the engaging forward end 20*a* of plug shell 20. Forward end 50*a* of coupling ring 50 is internally threaded at its engaging end, as indicated 54, to receive and rotatably engage threads 14 on receptacle shell 10, engagement between the threads 14, 54 drawing plug shell 20 into receptacle shell 10** and securing the connection therebetween.

A generally cylindrical sleeve 30 is adapted to position coupling ring 50 against radial flange 22. Disposed on the interior wall of the sleeve are internal threads 34 sized to engage the external threads 24 on plug shell 20.

A waved washer 60 is adapted to be axially positioned between the sleeve 30 and coupling ring 50, one axial face of the washer abutting against radial flange 52 of coupling ring 50 and the other axial face of the washer abutting against the forward end face 32 of sleeve 30. Waved washer 60 normally biases the coupling ring towards plug shell flange 22. Alternatively, instead of the sleeve and waved washer rotatably captivating the coupling ring, a snap ring could be fitted in an annular groove as shown in the aforementioned U.S. Pat. No. 4,268,103.

Preferably and in accord with the invention, means for resisting uncoupling rotation of the coupling ring, operative between the coupling ring and the connector assembly, are provided. Rearwardly of annular flange 22 and forwardly of threaded portion 24 of plug shell 20 is positioned a plastic portion 70 having an external frusto-conical surface 72. A plurality of protuberances 74 are disposed radially around and extend upwardly from the plastic portion of the frusto-conical surface 72, each of the protuberances being integrally molded therewith. Similarly, coupling ring 50 is provided with a plastic portion 80 having an internal frusto-conical surface 82. A plurality of sockets (i.e., detents) 84 are disposed radially around and extend inwardly into surface 82 of plastic portion 80, each of the sockets being sized to receive one of the respective protuberances on connector plug 20. Each of the protuberances and sockets are generally hemispherical. To provide plastic portions 70, 80, connector housing 20 as well as coupling ring 30 could be integrally molded of plastic. As such, the means for resisting rotation would not only be self-contained but also of one-piece construction.

Any suitable material that is basically a high dielectric, glass-filled thermoplastic, exhibiting high impact strength, excellent thermal characteristics, low moisture absorption, excellent aging properties and high mechanical attributes would be desired. Some suitable materials would be a phenylene oxide based resin, such as that manufactured by General Electric as Noryl EN 265 Noryl PX-1394, a polyester, such as that manufactured by General Electric as Valox DR-48 and a polyamide-imide, such as that manufactured by Amoco as Torlon 4203. Other suitable thermoplastics would include polyamides, polyarylsulfones, polyphenylsulfones, polyphenylsulfone resins, polyether sulfones and polyphenylene sulfides.

FIG. 2 is an end view of the rearward non-engaging end **20*b* of plug shell 20 showing the plastic portion 70 having the plurality of protuberances 74 and the wires 27 extending from insert 28, each of the protuberances being radially disposed and generally equiangularly spaced, one from the other, about frusto-conical surface 72**. More or fewer protuberances could be utilized, if desired.

FIG. 3 is an end view of coupling ring 50 and shows the plastic portion 80 having the plurality of sockets 84, each of the sockets being radially disposed and generally equiangularly spaced, one from the other, about frusto-conical surface 82. The coupling and/or uncoupling directions are as indicated. More or fewer sockets could be utilized, if desired.

Figure 4:
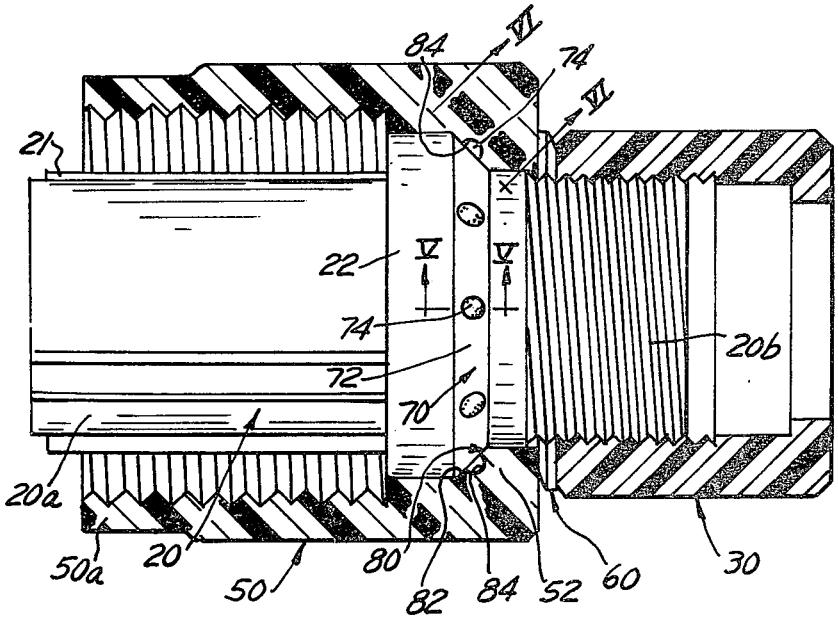
FIG. 4 is the coupling ring mounted to the electrical connector housing.

FIG. 4 shows sleeve 30, waved washer 60 and coupling ring 50 mounted to plug shell 20, radial flange 52 clearance fitting about the rearward end of the plug shell. The plurality of protuberances 74, equiangularly spaced on their common circle, have been received in respective of the plurality of sockets 84, equiangularly spaced on their common circle.

Figure 5:
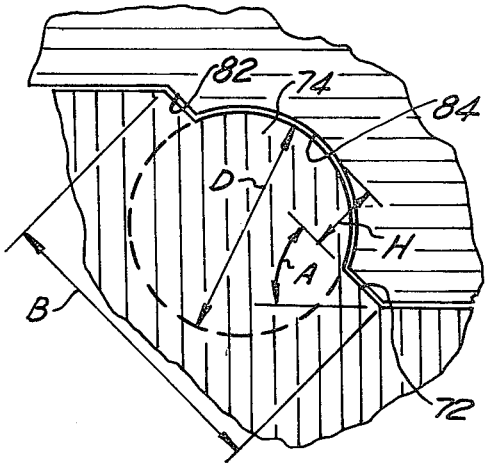
FIG. 5 is a cross-sectional view taken along lines V—V of FIG. 4 showing detail of a protuberance on the coupling ring protuberance fitting within a socket of the connector housing.

FIG. 5 is an enlarged view showing protuberance 74 received in socket 84 and the frusto-conical surfaces 72, 82 in confronting relation. The protuberances and sockets are hemispherically shaped and substantially all of the protuberance fits in the socket. The height of protuberances 74 from surface 72 and/or depth of sockets 84 into surface 82 are about the same and are represented by "H", dimension "H" being about $\frac{1}{3}$ the "geometrical" diameter "D" of the protuberance. The geometrical diameter "D" is determined by using about 80% of the shortest 45° angle "A" hypotenuse "B" measured from the outer diameter of the plug shell rearward end 20*b* to the outer diameter of flange 22. The "circle" of protuberances and the "circle" of sockets (i.e. detents) are adapted to place the protuberances in register with sockets. Although any number of protuberances and/or sockets can be utilized, preferably in accord with this invention, one embodiment defined a ratio of about 1:10 wherein eight protuberances were provided for receipt within 80 sockets (i.e. detents). Such a design allowed for sufficient resistance to decoupling rotations without an excessive resistance to coupling rotations.

It is to be appreciated that the frusto-conical surfaces (i.e., angled faces) on the plug shell and coupling ring serve an added feature to anti-decoupling. That feature is that the 45°-angled surfaces aid in centering the connector members during coupling and uncoupling motions as well as during vibration which could cause the two members to hammer relative to one another. Centering each of the protuberances with their respective sockets enhances the engagement between each.

OPERATION

The elastic compressibility of the plastic portions 70, 80 is believed to be the basis upon which resistance to coupling and anti-decoupling forces resides. A user would be able to provide, by hand, the requisite torque to overcome the elastic deformation in either coupling or uncoupling motions. However, vibration forces typically would not be so able. Further, not all thermoplastics will work. For example although some acetals (e.g. Celcon and Delrin) have a low coefficient of friction and some fluorocarbons (e.g. Teflon) have excellent wear resistance, these plastics are not desirable since they tend to exhibit too high an elongation with plastic creep (i.e. cold flow). Additionally, a relatively imcompressible material, such as metal, would not work and function to provide the unexpected results disclosed herein.

Figure 6:
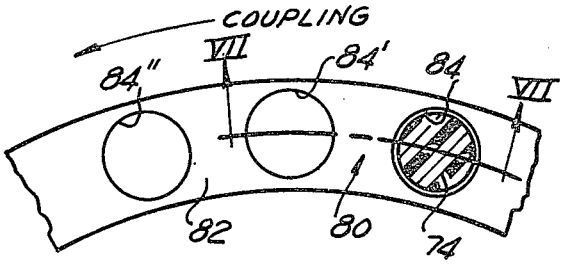
FIG. 6 is a plan view looking rearwardly along lines VI—VI of FIG. 4 showing another protuberance fitting in a first socket.

FIG. 6 shows protuberance 74 (in section) being received in a first socket 84 and in position for advancement in a coupling direction to succeeding radially spaced sockets 84' and 84''.

Figure 7:
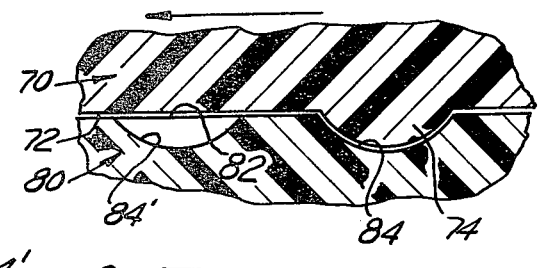
FIG. 7 is an sectional view of the protuberance and socket taken along lines VII—VII of FIG. 6.

FIG. 7 shows the close clearance fit between plastic portions 70, 80 with frusto-conical surfaces 72, 82 contacting and protuberance 74 received in socket 84.

Figure 8:
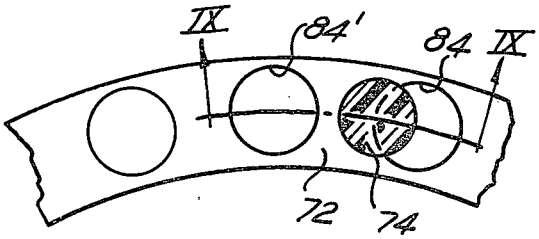
FIG. 8 shows the protuberance of FIG. 6 being rotated in the coupling direction towards a second socket.
Figure 9:
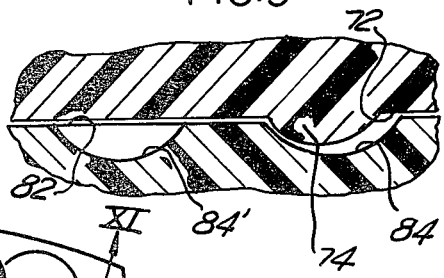
FIG. 9 is an sectional view of the protuberance and sockets taken along lines IX—IX of FIG. 8.

FIGS. 8 and 9 show initial coupling rotation of protuberance 74 from socket 84 in the coupling direction. In FIG. 9, as protuberance 74 is urged in the coupling direction to the next socket 84', protuberance 74 has started to elastically deform the socket (i.e. detent cavity) 84 and its own hemispherical shape.

Figure 10:
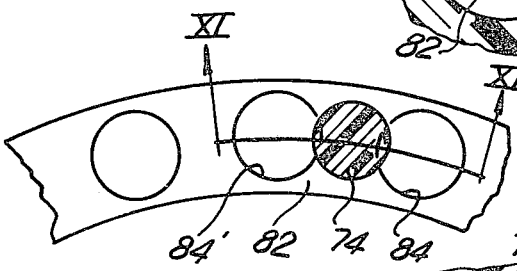
FIG. 10 shows further rotation of the protuberance in the coupling direction.
Figure 11:
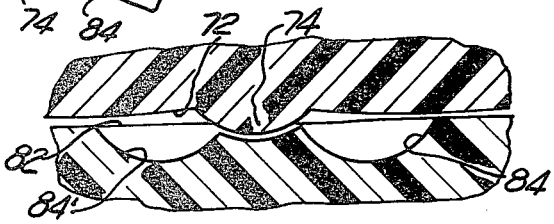
FIG. 11 is an sectional view taken along lines XI—XI of FIG. 10.

FIGS. 10 and 11 show protuberance 74 midway between sockets 84, 84'. The frusto-conical surface 72 on the plug shell as well as protuberance 74 is elastically yielding. The same would be true for each of the protuberances 74 disposed around plastic portion 72 with respect to their immediate sockets. Due to contact by protuberances 74, the intermediate frusto-conical surface 82 between sockets 84, 84 elastically yields.

Axial pressure is generated by the threaded advancement of the coupling ring onto the receptacle. A larger number of protuberances would increase the resistance to rotation.

While preferred embodiment of the invention has been disclosed, it will be apparent to those skilled in the art that changes may be made to the invention as set forth in the appended claims and, in some instances, certain features of the invention may be used to advantage without corresponding use of other features. For example, a weak waved washer, although desirable in reducing wear, could frustrate the necessary elastic compression of the thermoplastic and would, in some instances, not be desirable. Accordingly, it is intended that the illustrative and descriptive materials herein be used to illustrate the principals of the invention and not to limit the scope thereof.

Having described the invention what is claimed is:

1. An electrical connector assembly including a pair of connector housings which are moveable along a primary axis from an uncoupled position to a coupled position, a coupling ring rotatably mounted to one of said connector housings for drawing the other connector housing therewithin, and means for resisting rotation of the coupling ring, said resisting means characterized in that:

one of said connector housings includes a first surface (72);

said coupling ring includes a second surface (82) disposed in confronting relation to the first surface (72);

a plurality of equally spaced protuberances (74) extending outwardly from one of said surfaces (72), each said protuberance being comprised of an elastically deformable material and a plurality of equally spaced sockets (84) extending inwardly from the other of said surfaces (82), each of said protuberances (74) and said sockets (84) being generally hemispherically shaped, the protuberances (74) being received within respective of the sockets (84) and each being required to elastically deform to advance into its next adjacent socket upon application of an external torque tending to rotate the coupling ring, whereby as the coupling ring is rotated each protuberance elastically deforms and advances to its next succeeding socket.

2. An electrical connector assembly according to claim 1 wherein each of said surfaces (72, 82) are frusto-conically shaped relative to the primary axis of the connector assembly, each of said sockets being sized to receive substantially all of said protuberances when registered therewith.

3. An electrical connector assembly according to claim 1 wherein said first and second surfaces (72, 82) are comprised of an elastically deformable plastic.

4. An electrical connector assembly according to claim 3 wherein said one housing (20) includes said first surface (72) and a radial flange (22) for positioning the first surface in confronting relation to said second surface (82) on coupling ring (50).

5. An electrical connector assembly according to claim 4 wherein the compressible plastic forming said surfaces (72, 82) is chosen from a group consisting of polyamides, polyamide-imides, polyesters, polyphenylsulfones, polyphenylsulfone resins, polyether sulfones, polyphenylene sulfides, phenylene oxide based resins and polyarylsulfones.

6. An electrical connector assembly according to claim 2 wherein said protuberances (74) extend outwardly from the first surface and sockets (84) extend inwardly into the second surface, the extensions being substantially the same and in the range between 30–40% of the diameter defining their hemispherical shape.

7. An electrical connector assembly according to claim 6 wherein the outward and inward extensions, respectively of the protuberances (74) and sockets (84) is about 33% of their hemispherical diameters.

8. An electrical connector assembly according to claim 4 wherein the first and second surfaces (72, 82) are non-metallic and further comprising means (60) for biasing the first and second surfaces in close contact to one another.

9. An electrical connector assembly according to claim 4 wherein the second surface (72) is integral with the coupling ring (50) and the protuberances (74) are integrally formed with the one housing (20).

10. An electrical connector assembly as recited in claim 9 wherein the ratio of protuberances to sockets is approximately 1:10.

11. An electrical connector assembly including a pair of electrical connector housings (10, 20) which are movable from a decoupled position to a mated position, a coupling ring (50) mounted for rotation on one housing (20) and arranged to be threaded on the other housing (10) to move and couple the housings together in the mated position, and means (72, 74, 82, 84) operative between said coupling ring and one of said housings for resisting unwanted rotation of the coupling ring, said assembly characterized in that:

said one housing (20) includes a first portion (70) having a frusto-conical surface (72) comprised of an elastically deformable material;

said coupling ring (50) includes a second portion (80) comprised of an elastically deformable material having a frusto-conical surface (82) confronting the first portion (70);

a plurality of sockets (84) disposed in one of said frusto-conical surfaces (82); and an integral protuberance (74) comprised of an elastically deformable material extending outwardly from the other of said frusto-conical surfaces (72), said protuberance being received in one of said plurality of sockets and required to undergo elastic deformation to succeed into other of said sockets upon application of an external torque tending to rotate the coupling ring, whereby as external torque is applied to the coupling ring the first and second surfaces and the protuberance elastically deform and the protuberance is constrained to succeed from the one socket to the next socket.

12. An electrical connector assembly as recited in claim 11 wherein a plurality of protuberances (74) extend outwardly from said other frusto-conical surface (72) to engage respective ones of the sockets (84) disposed in said one frusto-conical surface (82), the plurality of protuberances being substantially less than the plurality of sockets.

13. An electrical connector assembly as recited in claim 12 wherein the ratio of the number of balls to sockets is approximately 1:10.

14. An electrical connector assembly of the type having:

a first housing (20) having a central axis, a forward engaging portion (20*a*), a rearward portion (20*b*), and an annular groove around the rearward portion;

at least one first electrical contact (26) mounted in the housing; and a coupling ring (50) rotatably mounted to and disposed around the first housing (20), said coupling ring having a rear portion (52) and a cylindrical forward portion (50*a*) connecting to a similar second housing (10) having at least one second electrical contact (16) mating with said first electrical contact (26), characterized by:

said coupling ring (50) including a first tapered surface (82) of elastically deformable plastic disposed therearound; and one of said housings (20) having a radial flange (22) including a second tapered surface (72) of elastically deformable plastic disposed therearound;

said first tapered surface (82) of elastically deformable plastic including a plurality of sockets (84) extending inwardly therein; and said second tapered surface (72) including a plurality of protuberances (74) extending outwardly therefrom and fit within succeeding of the sockets (84) on the coupling ring, elastic deformation of each said protuberance being required for the coupling ring to rotate.

15. The electrical connector assembly as recited in claim 14 wherein each said coupling ring (50) and said first connector housing (20) is integrally formed into one piece and comprised of a resilient plastic material, said tapered surfaces (72, 82) being circumferentially extending with their respective surfaces described by a hypotenus (B) generally inclined at between 40° to 50° to the central axis, and said protuberances (74) and sockets (84) extend substantially perpendicularly from their respective tapered surfaces by a distance (H), said distance (H) being approximately 80% of the distance defined by the hypotenus.

16. An electrical connector assembly comprising a connector housing having a primary axis, a coupling ring rotatably mounted to said connector housing, and means for reducing rotation of the coupling ring, said resisting means being characterized in that:

said connector housing includes a first surface;

said coupling ring includes a second surface disposed in confronting relation to the first surface; and one and the other said first and second surfaces include, respectively, a plurality of sockets and a plurality of protuberances spaced equiangularly therearound, each said socket extending inwardly into its respective surface, and each said protuberance being comprised of an elastically deformable plastic material and extending outwardly from its respective surface, each of said sockets and protuberances being generally hemispherically shaped and each of the protuberances being received within respective of the sockets and each being required to elastically deform in order to advance into its next adjacent socket upon application of an external torque tending to rotate the coupling ring, whereby as the coupling ring is rotated each protuberance elastically deforms and advances to its next succeeding socket.

17. The assembly according to claim 16 wherein each of said surfaces are frusto-conically shaped relative to the primary axis of the connector housing.

18. The assembly according to claim 16 wherein said first and second surfaces are comprised of an elastically deformable plastic material.

19. The assembly according to claim 16 wherein the second surface is integral with the coupling ring and the sockets are disposed around the second surface, each of said sockets being sized to receive substantially all of said protuberances when registered therewith.

* * * * *